US007572158B2

(12) United States Patent
Brown et al.

(10) Patent No.: US 7,572,158 B2
(45) Date of Patent: Aug. 11, 2009

(54) MARINE OUTDRIVE

(75) Inventors: Danny J. Brown, Ilderton (CA); Peter C. Hledin, Holland, MI (US)

(73) Assignee: Douglas Marine Corporation, Douglas, MI (US)

( * ) Notice: Subject to any disclaimer, the term of this patent is extended or adjusted under 35 U.S.C. 154(b) by 0 days.

(21) Appl. No.: 11/914,577

(22) PCT Filed: May 11, 2006

(86) PCT No.: PCT/US2006/018172

§ 371 (c)(1),
(2), (4) Date: Nov. 16, 2007

(87) PCT Pub. No.: WO2006/124482

PCT Pub. Date: Nov. 23, 2006

(65) Prior Publication Data

US 2008/0220668 A1 Sep. 11, 2008

Related U.S. Application Data

(60) Provisional application No. 60/594,879, filed on May 16, 2005.

(51) Int. Cl.
*B63H 21/165* (2006.01)

(52) U.S. Cl. ..... 440/6; 418/259

(58) Field of Classification Search ..... 440/5; 418/259, 266–268
See application file for complete search history.

(56) References Cited

U.S. PATENT DOCUMENTS 3,139,062 A * 6/1964 Keefe ..... 440/5
3,767,335 A * 10/1973 Kramer et al. ..... 418/259
3,901,177 A 8/1975 Worthington
4,355,965 A * 10/1982 Lowther ..... 418/111
4,551,080 A * 11/1985 Geiger ..... 418/28
4,649,612 A 3/1987 Sakamaki et al.

* cited by examiner

*Primary Examiner*—Ed Swinehart
(74) *Attorney, Agent, or Firm*—McGarry Bair PC

(57) ABSTRACT

A marine outdrive has a hydraulic vane motor with a spool shaped rotor eccentrically mounted in a fusiform shaped housing. The resulting increased vane area results in greater torque and speed.

8 Claims, 4 Drawing Sheets

MARINE OUTDRIVE

CROSS-REFERENCE TO RELATED APPLICATIONS

This application claims priority of International Application No. PCT/US2006/018172, filed May 11, 2006, which is incorporated herein in its entirety.

BACKGROUND OF THE INVENTION

1. Field of the Invention

The invention relates to the field of marine propulsion systems, and more particularly, to hydraulically powered marine outdrives.

2. Description of the Related Art

Marine propulsion systems can be classified into three broad categories: inboard, outboard, and inboard/outboard. Inboard systems typically have an inboard engine that drives a propeller on a fixed propeller shaft extending through the hull or transom with steering provided by a separate rudder. Outboard systems typically have the entire engine, drive train and propeller in a single unit mounted to the transom with steering provided by rotating the entire unit. Inboard/outboard systems typically have an inboard engine with an outboard drive system (usually a propeller) mounted to the transom, with steering provided by rotating the outboard drive. Inboard/outboard systems offer more mobility than inboard systems, and greater horsepower than purely outboard units. The term "outboard drive" is often shortened to "outdrive" and refers to the fact that the entire drive unit apart from the engine and transmission are located overboard, normally on the transom of the boat. This feature is critical to the vessel's trim, tilt and steering operations. With this type of system propulsion is achieved when rotation is transmitted from an inboard mounted engine through some form of drive train to a propeller located below the water line. Instead of a rudder setup, steering is executed by changing the angle of the entire unit in a plane parallel to the water surface. By varying this angle, propeller thrust is redirected and the vessel's course altered. The ability to direct propeller thrust makes the vessel responsive and extremely maneuverable, a feature that appeals to both commercial and pleasure boat owners.

In some known inboard/outboard systems, rotation from the inboard engine is reduced by a transmission and then directly coupled to the outdrive by a universal joint. Power is then transmitted through an arrangement of clutches, bevel gears and shafts to the propeller located below the water surface. Such fixed gear ratio arrangements tend not to use fuel to the utmost efficiency. For example, accelerating a boat from a standstill requires more horsepower than any other time during operation, and this occurs when the engine is running at low rpm and producing very little horsepower. At that time engines are over fueled in order to create more horsepower. However most of this excess fuel that is delivered to the engine is exhausted and not used. Also, particular engines, and particularly diesel engines, have a peak performance within a narrow rpm range, so in fixed ratio systems, the engine will be operating efficiently in a limited number of boat speeds and so most often will be operating with reduced fuel efficiency, causing increased costs and pollution. As well, the universal joint which must penetrate the transom of the boat is both a weak link in the drive train, as well as a difficult area to seal.

Various designs have been proposed wherein the inboard engine is used to drive a hydraulic pump, and the hydraulic pump provides hydraulic fluid under pressure to an outboard reversible hydraulic motor which drives the propeller shaft, eliminating the need for a mechanical linkage through or over the transom. See, for example, U.S. Pat. No. 3,139,062 to Keefe, U.S. Pat. Nos. 3,587,511 and 3,847,107 to Buddrus, and U.S. Pat. No. 3,599,595 to James. In these disclosures, a hydraulic motor is mounted on the propeller shaft, below the water line. But such designs result in large drag due to the volume of the housing which is below the water line. To reduce drag requires reducing the cross-sectional profile of the housing, which necessarily reduces and limits the power output of the motor.

In U.S. Pat. No. 2,486,049 to Miller and U.S. Pat. No. 3,673,978 to Jeffrey et al. the hydraulic motor is mounted above the water line and connects to the propeller shaft through bevel gears. In U.S. Pat. No. 5,813,887 to Mark, the hydraulic motor above the water line connects to the propeller shaft by a chain drive. But all such mechanical linkages have inherent disadvantages found in vibrations and noise, limitations on turning angles, maintenance and repair, added lubrication requirements, and cost.

There is a need for a lower cost, lower maintenance, simpler, high performance hydraulic marine outdrive.

SUMMARY OF THE INVENTION

According to the invention, a hydraulic motor for a marine outdrive comprises a hydraulically driven vane motor with vanes reciprocally mounted to a rotor disposed eccentrically within a housing for rotation about an axis. The invention is characterized by the rotor being spool-shaped wherein the effective area of each vane is greater intermediate the ends of the rotor than at the ends of the rotor. The housing is preferably shaped as a truncated fusiform and the vanes have an edge complementary to the housing shape.

In one aspect, the rotor has a hollow shaft extending the length of the rotor on the axis. In another aspect, the hydraulic motor comprises a second hydraulically driven vane motor in tandem with the first vane motor, a diverter manifold fluidly connected to each vane motor, and a control valve fluidly connected to the diverter manifold for controlling the flow of hydraulic fluid to either or both vane motors.

In another aspect of the invention, a marine propulsion system comprises an inboard engine, a hydraulic pump driven by the engine, and an outdrive fluidly connected to the hydraulic pump, the outdrive having a hydraulically driven vane motor of the aforementioned construction

DETAILED DESCRIPTION

Figure 1:
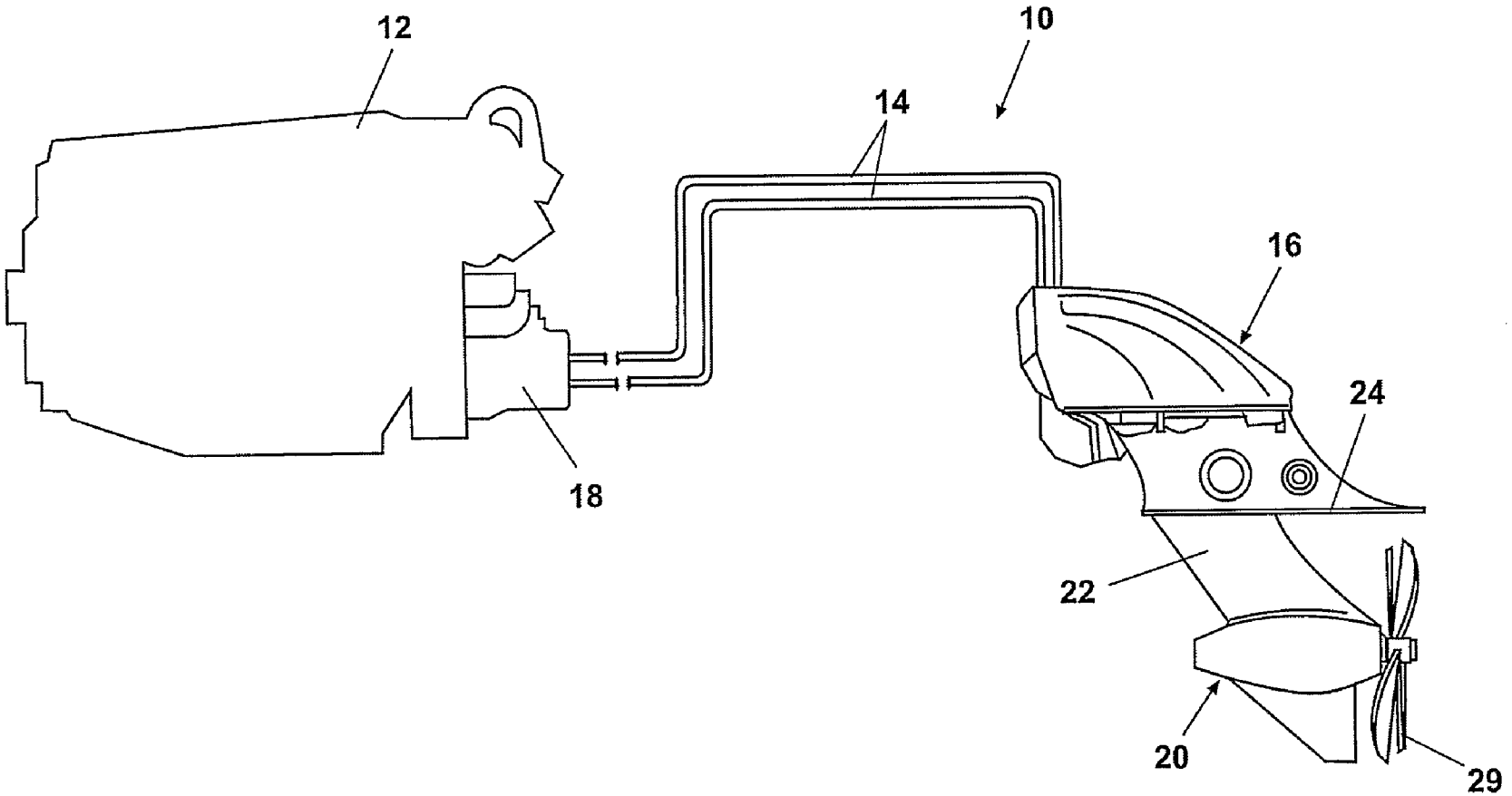
FIG. 1 is a schematic view of an inboard/outboard propulsion system with a marine outdrive according to the invention.

A marine propulsion system 10 of the present invention is shown in FIG. 1, and comprises a conventional internal combustion engine 12, mounted inboard, fluidly connected by hydraulic lines 14 to an outdrive 16. The outdrive 16 is pivotably mounted, preferably by a gimbal mechanism, to the transom of the boat. At least one pump 18 is disposed in the fluid lines between the engine 12 and the outdrive 16. The pump 18 is preferably mounted inboard with the engine 12, but it can be positioned in the outdrive 16. Also, a primary pump can be located with the engine 12, and an auxiliary pump can be disposed in the outdrive 16. Preferably, the pump 18 is a variable displacement pump that provides hydraulic fluid under pressure, through the hydraulic lines 14, to a reversible hydraulic motor 20 mounted on the outdrive 16, outboard of the transom. The motor 20 is carried near the bottom end of a hollow, vertically disposed housing 22, beneath a cavitation plate 24.

Figure 2:
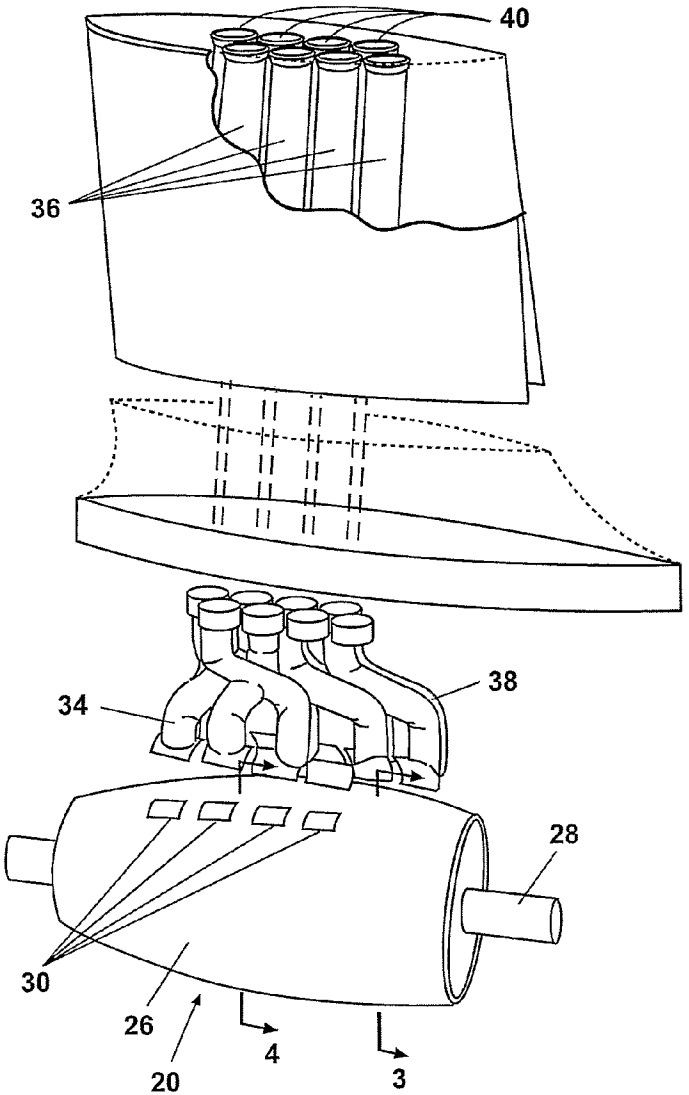
FIG. 2 is an isometric view, partly exploded, of a portion of the marine outdrive of FIG. 2.

Looking now also at FIG. 2, the motor 20 comprises a housing 26 generally having the shape of a truncated fusiform. A shaft 28, preferably hollow, extends from the housing 26 and is mounted therein for rotational movement by sealed bearings. A propeller 29 (see FIG. 1) is mounted to the shaft 28 for rotation therewith. A rank of inlet ports 30 is spaced from a similar rank of outlet ports 32 in the housing. An inlet manifold 34 fluidly connects to the rank of inlet ports 30 and also to a plurality of inlet conduits 36 disposed in the housing 26. Similarly, an outlet manifold 38 fluidly connects to the rank of outlet ports 32 and also to a plurality of outlet conduits 40 running parallel to the inlet conduits 36 in the housing. The inlet and outlet conduits 36, 40, in turn fluidly connect to the hydraulic lines 14 or to the auxiliary pump.

Figure 3:
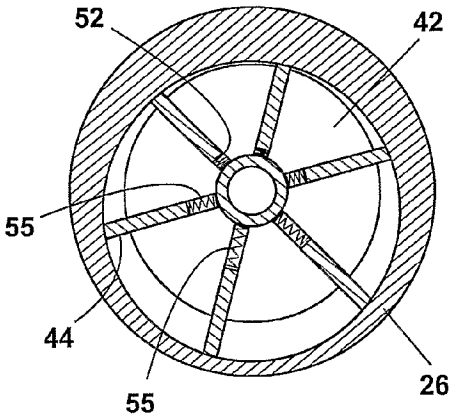
FIG. 3 is a cross sectional view of the motor housing taken along line 3-3 of FIG. 2.
Figure 4:
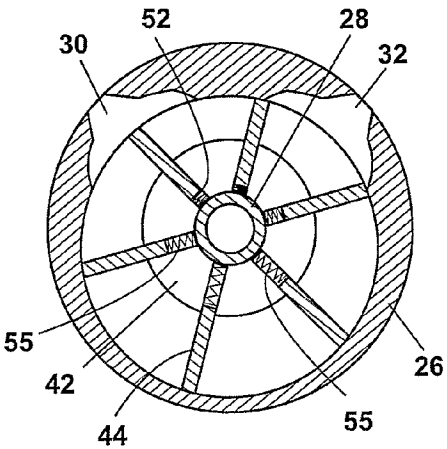
FIG. 4 is a cross sectional view of the motor housing taken along line 4-4 of FIG. 2.
Figure 5:
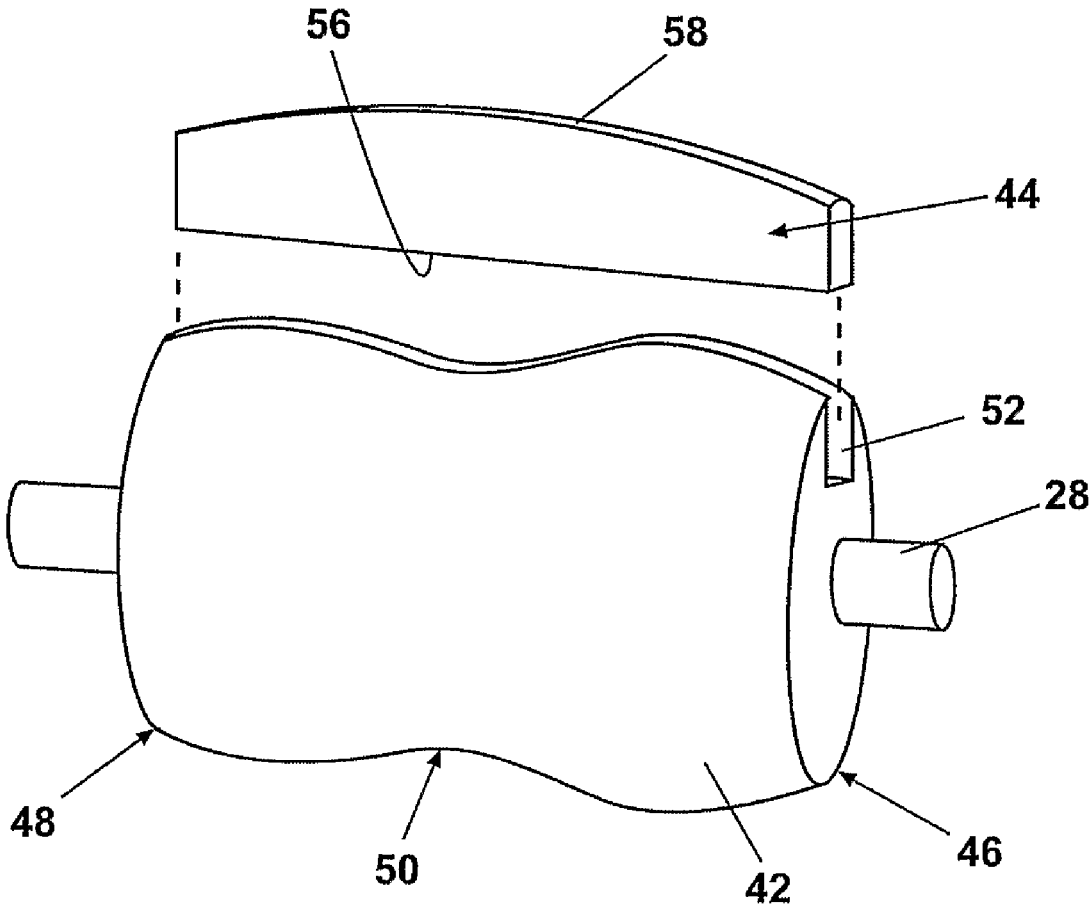
FIG. 5 is an isometric view showing the vane and rotor structure of the motor in the marine outdrive according to the invention.

Inside the motor 20, as shown in FIGS. 3-5, the hollow shaft 28 carries a rotor 42 that has a plurality of vanes 44 extending therefrom. In the embodiment illustrated, there are six vanes, but it will be clearly understood that more or less vanes can be provided. In FIG. 5 only one vane 44 is illustrated. The rotor 42 is spool-shaped wherein the diameter of the rotor at the ends 46, 48 and in the middle 50 is less than the diameter of the rotor elsewhere. Thus, instead of the rotor 42 having a truncated fusiform shape as does the housing 26 in which the rotor rotates, there is a greater distance between the middle 50 of the rotor and the wall of the housing 26 then at other locations on the rotor. The more truncated the fusiform shape, the less drag is cause by the motor 20 as the vessel moves through the water. Importantly, the rotor 42 is not centered within the housing 26; rather, it is eccentrically mounted.

Each vane 44 is preferably as long as the rotor 42 and is mounted to the rotor for reciprocal movement within a slot 52. A bias member 54 such as one or more springs 55 is mounted in the slot between the rotor 42 and a proximal edge 56 of the vane 44. A distal edge 58 of the vane has a shape complementary to the fusiform shape of the housing 26. As the rotor 42 rotates about the axis of the shaft 28 (disposed eccentrically within the housing 26), the vanes 44 reciprocate within the slots 52, with each distal edge 58 in sealing engagement with the interior wall of the housing 26. See FIGS. 3 and 4. It will be understood that, as in any vane-type hydraulic motor, hydraulic fluid under pressure entering the inlet ports 30 will bear against the adjacent vane 44, causing the rotor 42 and shaft 28 to rotate about the axis. The hydraulic fluid continues to sweep around the axis as the rotor rotates, exhausting through the outlet ports 32 according to the known principles of a vane motor. Because of the increased vane area, the motor delivers more torque and speed than known hydraulic motors. Because the shaft 28 is hollow, water can flow through it as the vessel moves to provide cooling.

Figure 6:
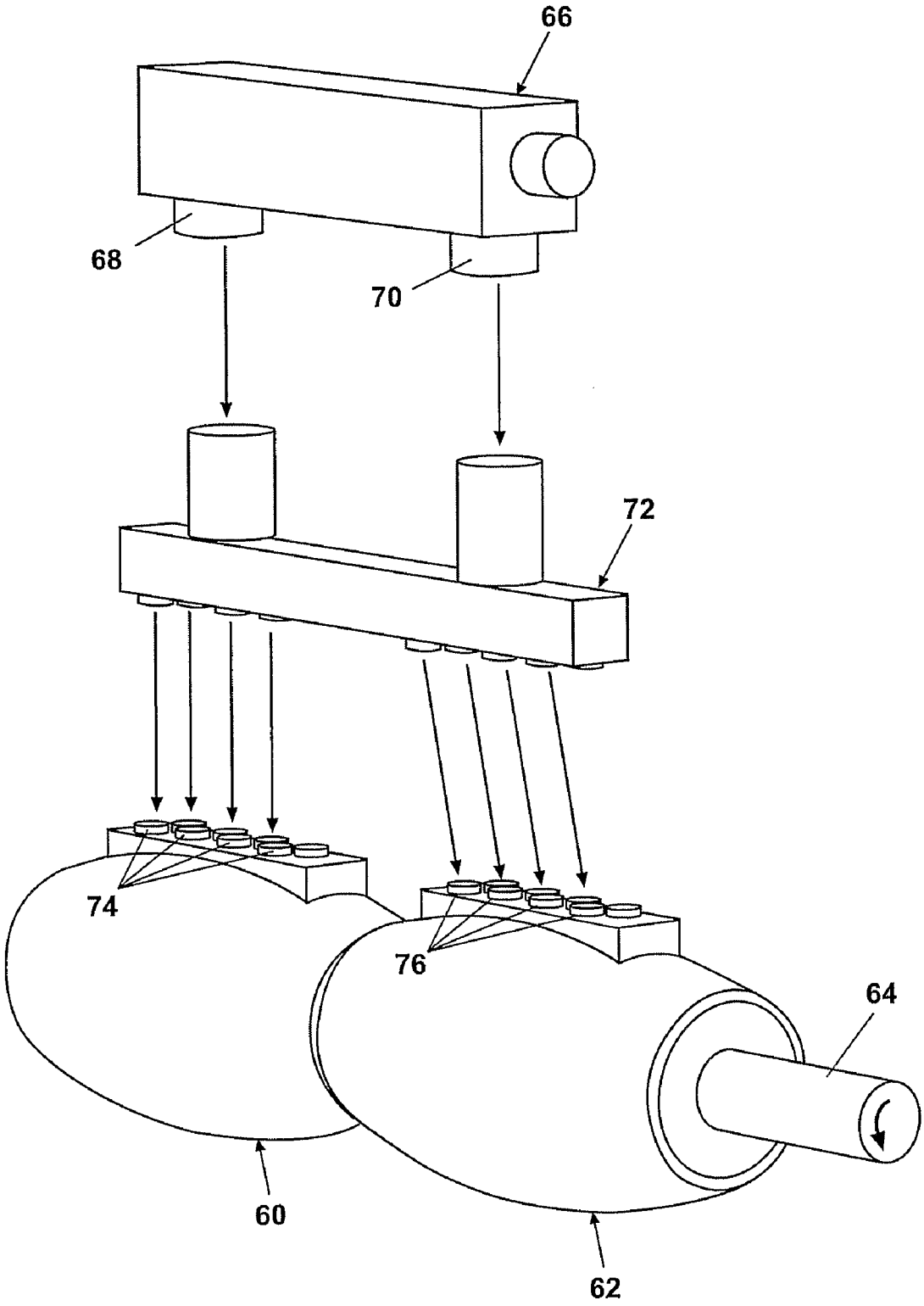
FIG. 6 is an isometric view of tandem motors in a second embodiment of the marine outdrive according to the invention.

In a second embodiment illustrated in FIG. 6, two hydraulic motors 60, 62, each of the aforementioned construction, are disposed in tandem along a single shaft 64. Preferably, the shaft is hollow. Hydraulic fluid is pumped through a control valve 66 that directs fluid flow through one or both ports 68, 70 to a diverter manifold 72. The diverter manifold 72 separates the flow into the individual inlet ports 74, 76 on each motor, respectively. There will preferably be a like structure on the outlet side of the motors. In this manner, the control valve 66 can control each motor individually. For minimal torque and speed, only one of the motors 60, 62 need be operated. For maximum torque and speed, the control valve 66 will permit flow to both motors.

It is understood that if the hydraulic fluid flow is reversed in the system, the propeller will be caused to rotate in a reverse direction wherein the vessel will be propelled rearwardly. Speed is controlled by controlling the pressure and volume of the hydraulic fluid.

While the invention has been specifically described in connection with certain specific embodiments thereof, it is to be understood that this is by way of illustration and not of limitation, and the scope of the appended claims should be construed as broadly as the prior art will permit.

What is claimed is:

1. A hydraulic motor for a marine outdrive comprising a plurality of hydraulically driven vanes reciprocally mounted to a rotor disposed eccentrically within a housing for rotation about an axis, characterized by the rotor being spool-shaped, the housing being shaped as a truncated fusiform, and the vanes having an edge complementary to the housing shape whereby the effective area of each vane is greater intermediate the ends of the rotor than at the ends of the rotor.

2. The hydraulic motor of claim 1 wherein the rotor has a hollow shaft extending the length of the rotor on the axis.

3. The hydraulic motor of claim 2 further comprising a second hydraulically driven vane motor in tandem with the first vane motor, a diverter manifold fluidly connected to each vane motor, and a control valve fluidly connected to the diverter manifold for controlling the flow of hydraulic fluid to either or both vane motors.

4. The hydraulic motor of claim 1 further comprising a second hydraulically driven vane motor in tandem with the first vane motor, a diverter manifold fluidly connected to each vane motor, and a control valve fluidly connected to the diverter manifold for controlling the flow of hydraulic fluid to either or both vane motors.

5. A marine propulsion system comprising an inboard engine, a hydraulic pump driven by the engine, and an outdrive fluidly connected to the hydraulic pump, the outdrive having a hydraulic motor with a plurality of hydraulically driven vanes reciprocally mounted to a rotor disposed eccentrically within a housing for rotation about an axis, characterized by the rotor being spool-shaped, the housing being shaped as a truncated fusiform, and the vanes having an edge complementary to the housing shape whereby the effective area of each vane is greater intermediate the ends of the rotor than at the ends of the rotor.

6. The marine propulsion system of claim 5 wherein the rotor has a hollow shaft extending the length of the rotor on the axis.

7. The marine propulsion system of claim 6 further comprising a second hydraulically driven vane motor in tandem with the first vane motor, a diverter manifold fluidly connected to each vane motor, and a control valve fluidly connected to the diverter manifold for controlling the flow of hydraulic fluid to either or both vane motors.

8. The marine propulsion system of claim 5 further comprising a second hydraulically driven vane motor in tandem with the first vane motor, a diverter manifold fluidly connected to each vane motor, and a control valve fluidly connected to the diverter manifold for controlling the flow of hydraulic fluid to either or both vane motors.

* * * * *